US006249992B1

(12) United States Patent
Irving et al.

(10) Patent No.: US 6,249,992 B1
(45) Date of Patent: Jun. 26, 2001

(54) RETRACTABLE SNOW PLOW WING ASSEMBLY

(75) Inventors: Donald Edwin Irving; Colin Edwin Irving, both of Tisdale; Kenneth Lawrence Furber, Sylvania; James Randolph Nickel, Carrot River, all of (CA)

(73) Assignee: Capital I Industries Inc., Tisdale (CA)

( * ) Notice: Subject to any disclaimer, the term of this patent is extended or adjusted under 35 U.S.C. 154(b) by 0 days.

(21) Appl. No.: 09/410,099

(22) Filed: Oct. 1, 1999

(51) Int. Cl.[7] ..... E01H 5/06

(52) U.S. Cl. ..... 37/281; 172/791; 172/786

(58) Field of Search ..... 37/274, 279, 281, 37/266; 172/297, 301, 302, 305, 309, 781, 782, 784, 786, 791, 792, 793, 794, 795, 796, 797

(56) References Cited

U.S. PATENT DOCUMENTS

| | | | | |
|---|---|---|---|---|
| 1,956,007 | * | 4/1934 | Davin et al. | 37/274 |
| 2,137,321 | * | 11/1938 | Austin | 37/274 |
| 2,524,329 | * | 10/1950 | Richardson | 37/274 |
| 2,750,688 | * | 6/1956 | Grabow | 37/281 |
| 2,991,566 | * | 7/1961 | Sumner et al. | 37/281 |
| 3,241,254 | * | 3/1966 | Ulrich | 37/274 |
| 3,720,010 | | 3/1973 | Coates . | |
| 3,908,289 | * | 9/1975 | Ross | 37/281 |
| 4,045,892 | | 9/1977 | Farrell . | |
| 4,077,139 | * | 3/1978 | Fagervold et al. | 37/281 |
| 4,096,652 | | 6/1978 | Raines et al. . | |
| 4,357,766 | | 11/1982 | Croteau et al. . | |
| 4,596,081 | | 6/1986 | DeBilly et al. . | |
| 4,744,159 | | 5/1988 | Houle . | |
| 4,969,280 | | 11/1990 | Thorneloe . | |
| 5,031,343 | | 7/1991 | Houle et al. . | |
| 5,048,207 | | 9/1991 | Verseef . | |

FOREIGN PATENT DOCUMENTS

| | | |
|---|---|---|
| 1082454 | 7/1980 | (CA) . |
| 1212540 | 10/1986 | (CA) . |

* cited by examiner

*Primary Examiner*—Victor Battson

(57) ABSTRACT

A side wing plow assembly is provided for use on a vehicle, e.g. a grader. It includes an elongated blade, an articulated forward connector assembly for connecting the inner end of the blade to the vehicle and a rear connector assembly for connecting the outer end of the blade to the vehicle rearwardly of the vehicle cab. Hydraulic cylinders tilt the blade and raise and lower the blade and a telescopic arm adjusts the angle of the blade. A shock absorbing linkage also permits the blade to bounce over an obstruction to avoid damage.

9 Claims, 6 Drawing Sheets

RETRACTABLE SNOW PLOW WING ASSEMBLY

FIELD OF THE INVENTION

The present invention relates to a side wing blade assembly for a snow plow vehicle and, more particularly, to a side wing blade assembly for use on a motor grader for plowing snow.

BACKGROUND OF THE INVENTION

Side wing blade assemblies are extensively used on snow plow vehicles. A typical side wing blade arrangement includes an elongated curved blade and an articulated attachment system for mounting the blade to the vehicle. Typically, a mounting system comprises a coupling for connecting the front end of the blade to a vehicle, and an articulated hanger unit for connecting the rear end of the blade to the vehicle chassis and also for tilting the wing between a plowing position and a retracted position. In the plowing position, the blade extends at an angle to the longitudinal axis of the vehicle engaging the road surface, while in the retracted position it is lifted up and extends generally parallel and close to the vehicle cabin.

Many different mounting systems have been tried over the years with changes from steel cables running over sheaves or pulleys to a variety of hydraulic cylinder systems. One such hydraulic cylinder actuated system is shown in Farrell U.S. Pat. No. 4,045,892. This includes a pair of generally vertical posts mounted on the side of the vehicle on which the front and rear of the side wing blade are attached. Not only are the posts intrusive, but with this design, when the blade is in the retracted position, it seriously interferes with the visibility of the vehicle driver.

The assembly shown in Canadian Patent 1,212,540 represents one attempt at solving the problem of obstructed vision. This still utilizes vertical post arrangements for connecting the front end and rear end of the blade to the vehicle. However, the mounting arranging on the vertical posts has been changed such that the blade in retracted position sits at a lower angle to avoid obstructing view of the vehicle driver.

In Thorneloe, U.S. Pat. No. 4,969,280 there is described a side wing assembly having a rear mounting arrangement which permits a controlled blade deflection to reduce the risk of damage to the snow plow or to the side wing assembly itself, when the blade hits an obstacle. This is accomplished by a fluid ram with stops limiting the amount of movement.

Raines et al. Canadian Patent 1,082,545 describes a retractable snow plow wing which does not use a vertical post for the rear attachment assembly. Instead, a telescopic arm is used which can be fixed at different lengths. The raising and lowering of the arm and rear end of the blade is accomplished by way of a hydraulic cylinder. A coil compression spring is utilized in association with the telescopic arm to absorb shock. The design of this patent is another one which seriously obstructs the view of the vehicle driver when the blade is in the retracted position.

It is an object of the present invention to provide an improved form of side wing plow assembly having a novel form of front mounting for the blade.

It is a further object of the present invention to provide an improved form of rear mounting for the blade which includes a novel shock absorbing linkage.

SUMMARY OF THE INVENTION

The present invention in its broadest aspect relates to a side wing plow assembly for use on a vehicle comprising an elongated blade, an articulated forward connector assembly for connecting the inner end of the blade to the vehicle and a rear connector assembly for connecting the outer end of the blade to the vehicle rearwardly of the vehicle cab. The articulated forward connector assembly includes a generally vertical inner plate member for attachment to the vehicle frame and a generally vertical outer plate member laterally spaced from the inner vertical plate. A transverse plate member is pivotally connected to the lower regions of the inner and outer plate members. An upper hydraulic cylinder is connected between upper regions of the inner and outer plate members and a lower hydraulic cylinder is connected between an upper region of the inner plate member and a lower region of the outer plate member. The upper cylinder is adapted to tilt the outer plate member and blade, while the lower cylinder is adapted to raise and lower the outer plate member and the blade. A blade support plate is hinged to the outer plate member by means of a vertical hinge, with the blade being connected to the support plate by means of a horizontal pivot pin which allows the blade to swing up and down relative to the support plate. The rear connector assembly includes a telescopic arm pivotally connected at its inner end to the vehicle and pivotally connected at its outer end to the outer end of the blade. This arm includes a hydraulic cylinder for extending and retracting the arm. A further hydraulic cylinder is pivotally connected between the vehicle and an upwardly extending bracket on the telescopic arm, this further hydraulic cylinder being adapted to raise and lower the outer end of the blade.

Preferably the hydraulic cylinder connected between the vehicle and the telescopic arm is connected to the upwardly extending bracket by way of a loose link in the form of a short pivot arm between the bracket and the end of the hydraulic cylinder. This pivot arm is adapted to lie in generally axial alignment with the hydraulic cylinder under normal operation and to swing upwardly into a generally vertical position when the blade encounters an obstacle. This allows the outer end of the blade to jump as much as 32 inches when it hits an obstacle.

The blade connector assemblies of this invention provide a number of advantages. For instance, by using the upper cylinder for tilting the outer plate member, the tilt of the blade can easily be changed. Furthermore, the forward connector assembly is capable of raising the front of the blade without blocking any vision to the side.

In the rear connector assembly, the loose link arrangement is limited in its movement thereby additional pressure can be applied if the blade shows a tendency to jump over hard snow drifts.

BRIEF DESCRIPTION OF THE DRAWINGS

Having now generally described the nature of the invention, reference will now be made to the accompanying drawings, showing by way of illustration a preferred embodiment thereof, and in which.

DESCRIPTION OF THE PREFERRED EMBODIMENTS

Figure 1:
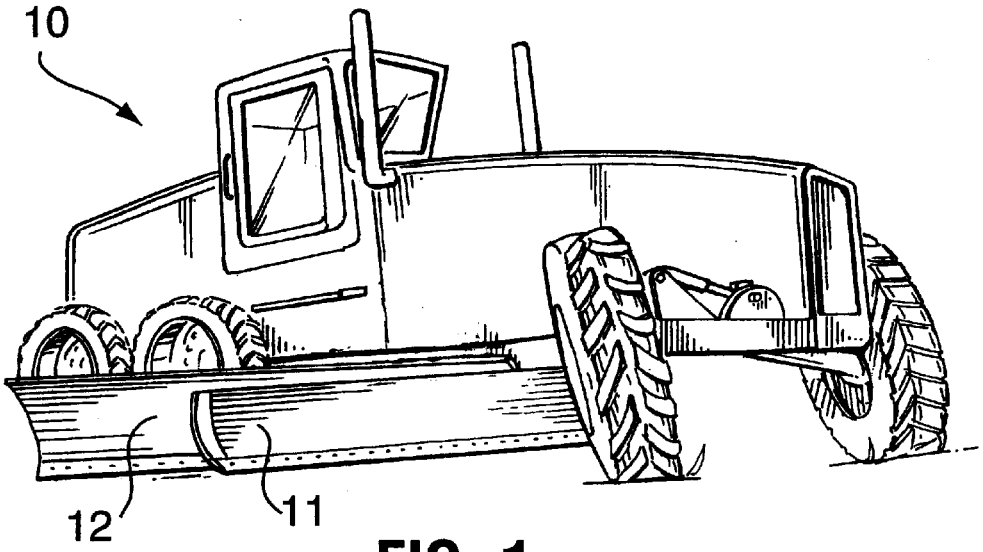
FIG. 1 is a perspective view of an arrangement in accordance with the present invention.

Referring now to the drawings, there is shown in FIG. 1 an outline of a motor grader 10 having a regular grader blade 11 mounted beneath the frame thereof. Mounted behind the grader blade 11 is a snow plow wing 12.

The front wing mounting assembly 13 has firstly an inner plate 15 which is bolted to the frame of the grader.

Connected to this is an inner U-shaped plate 16 and laterally spaced from this inner U-shaped plate is an outer U-shaped plate 17. These plates 16 and 17 are connected by way of a bottom box beam 18 which sits within the arms of the plates 16 and 17 and is connected by way of pivot pins extending through the side arms of plates 16 and 17 and the sides ok bottom beam 18. This arrangement allows the outer U-shaped plate 17 to move upwardly and downwardly and to tilt relative to the inner plate 16 and vehicle 10.

Figure 4:
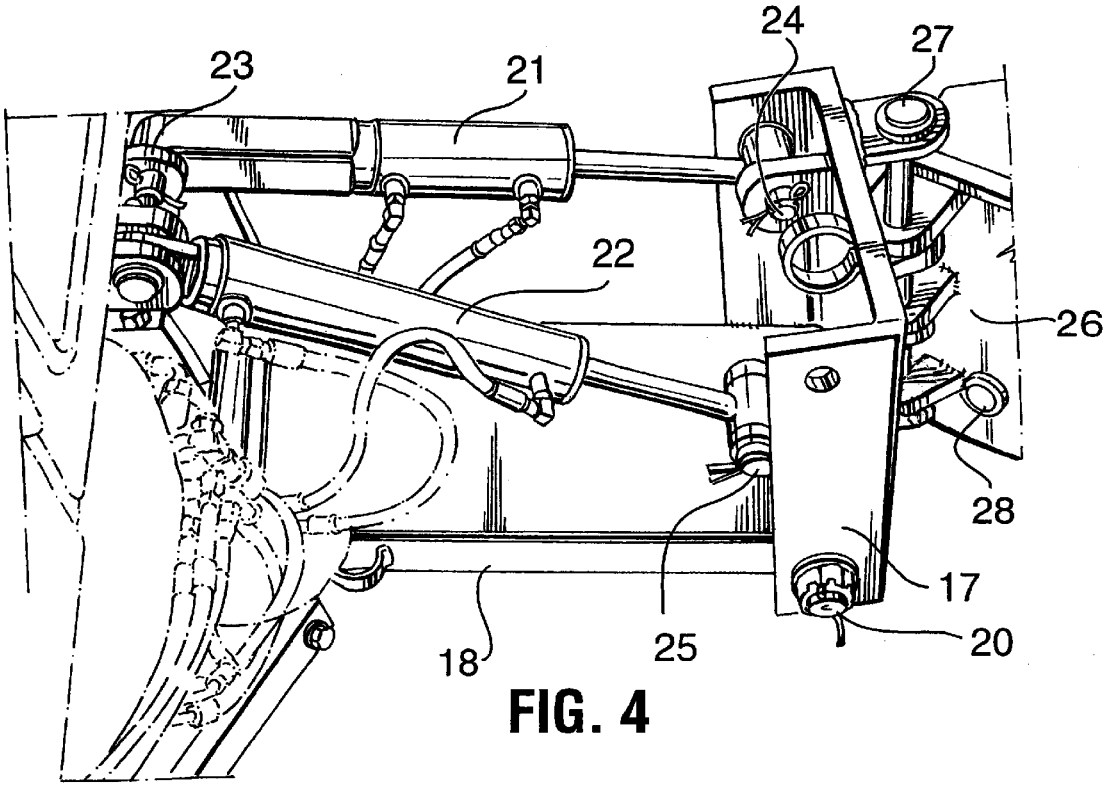
FIG. 4 is a detailed perspective view of the forward connector assembly.

As can be seen from FIG. 4, a pair of hydraulic cylinders 21 and 22 are pivotally connected to an upper region of inner U-shaped plate 16. One cylinder 21 extends across and is connected to an upper region of outer plate 17 by way of pivot pin 24 while cylinder 22 is angled downwardly to connect with the lower region of outer plate 17 by way of pivot pin 25. Thus it will be seen that by actuation of the upper cylinder 21 the angle of tilt of outer plate 17 can be varied, while the lower cylinder 22 serves to raise and lower the elevation of outer plate 17 and thus the blade 11.

Figure 2:
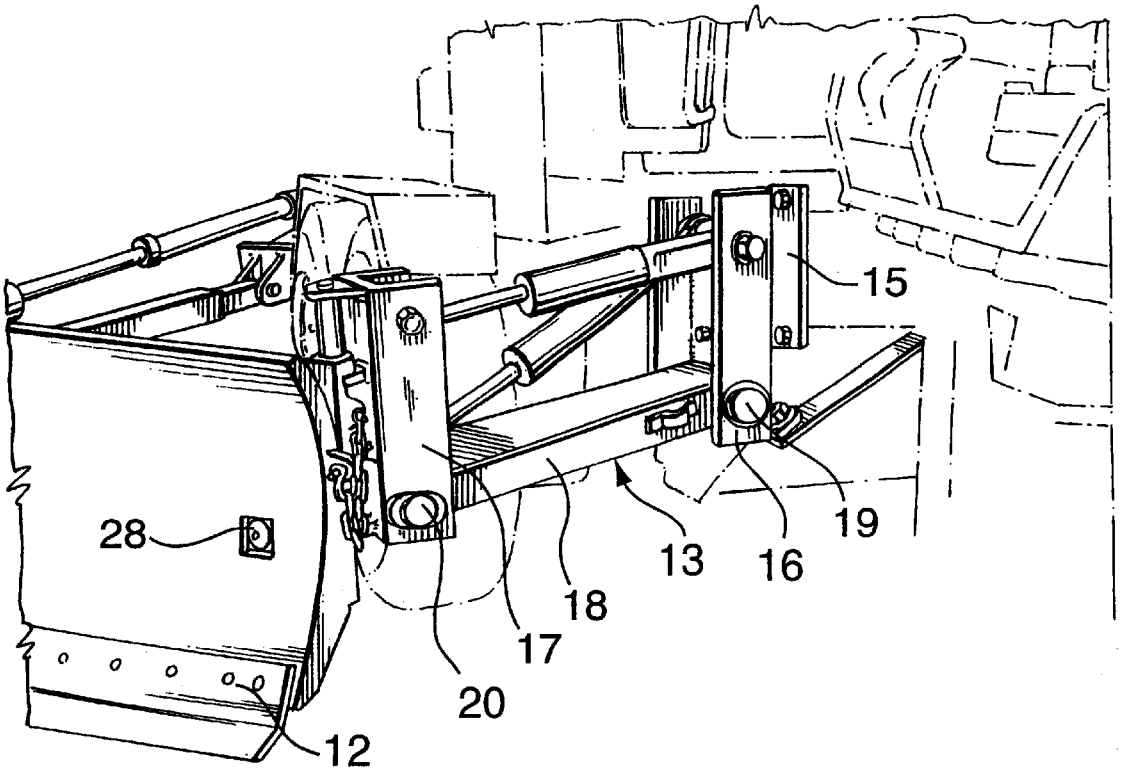
FIG. 2 is a more detailed perspective view of the forward connector assembly.
Figure 3:
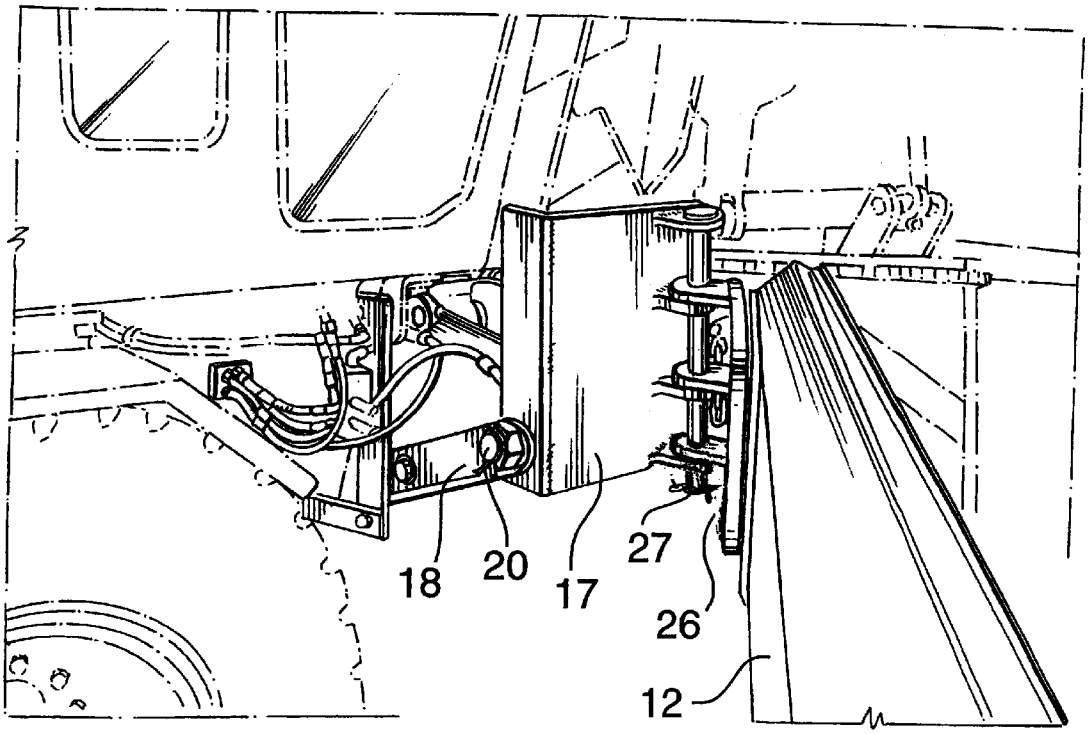
FIG. 3 is a further view of the forward connector assembly.

Connected to the outer face of the outer plate 17 is a blade mounting plate 26 which is connected to outer plate 17 by way of pivots or hinges 27. The inner end of blade 12 is connected to plate 26 by way of a single pivot pin 28 as can be seen in FIG. 2.

Figure 5:
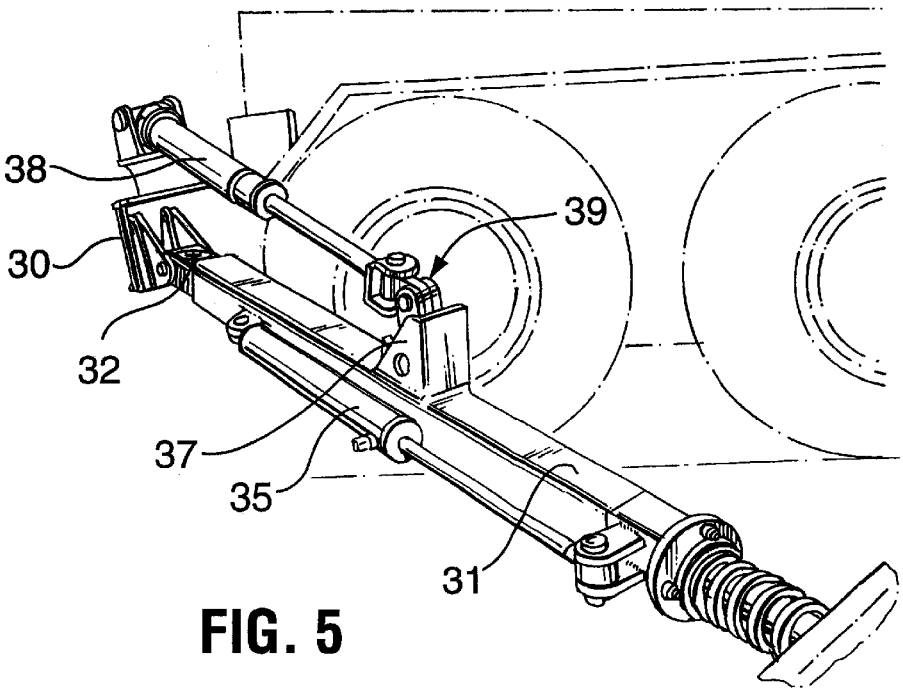
FIG. 5 is a perspective view of the rear connector assembly.
Figure 6:
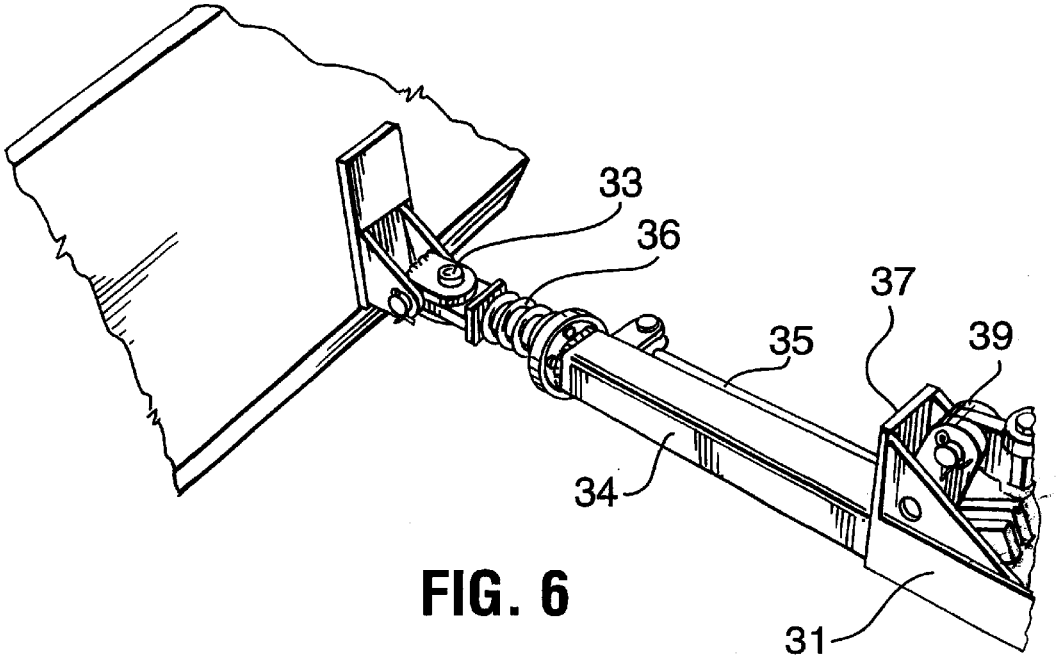
FIG. 6 is a detailed perspective view of the outer end of the rear connector arm.

The rear mounting assembly can generally be seen in FIG. 5 and includes a rear support member 30 which is connected to a rear portion of the frame of the grader 10. A telescopic arm 31 is connected to support 30 by way of double pivots 32 permitting lateral as well as up and down motion. The outer end of the telescopic arm is connected to the outer end of blade 12 again by a two-way pivot mounting 33.

The arm 31 includes a telescoping portion 34 actuated by a hydraulic cylinder 35. This determines the angle of the blade 11. The outer end of the arm also includes a coil compression spring 36 which functions as a shock absorber.

Figure 7:
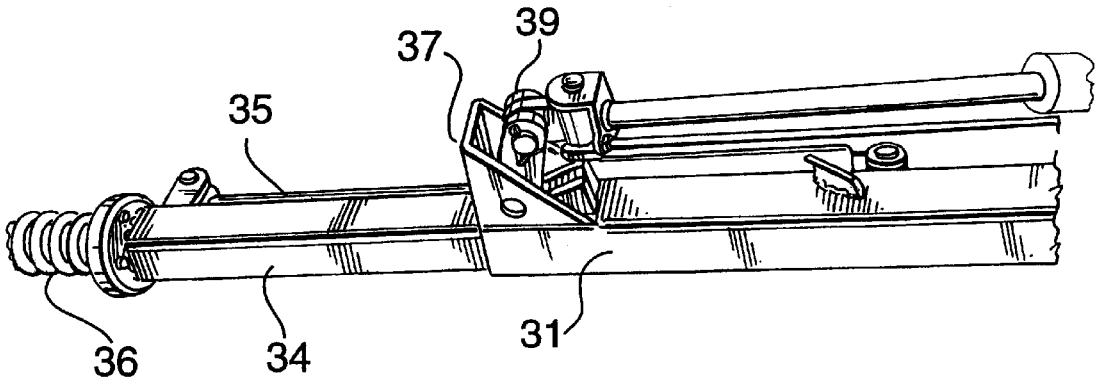
FIG. 7 is a perspective view of a loose link arrangement.
Figure 8:
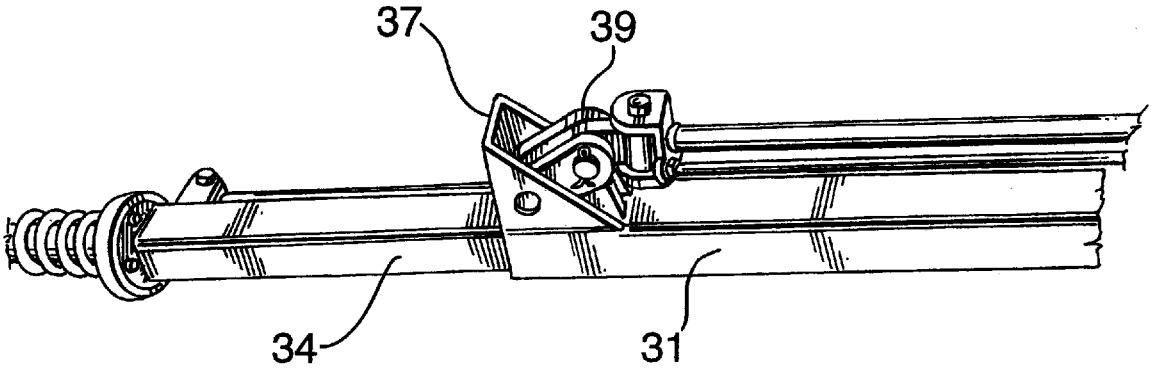
FIG. 8 is a further perspective view of a loose link arrangement.
Figure 9:
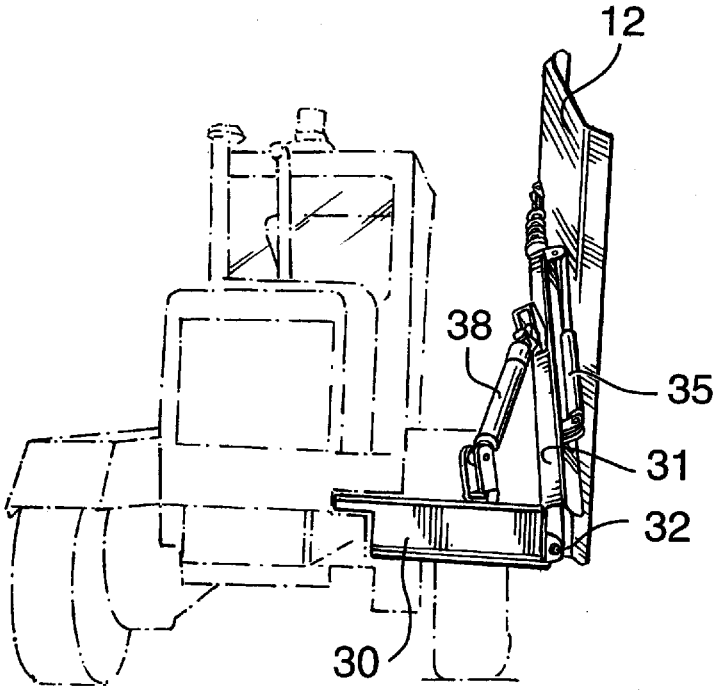
FIG. 9 is a view of a vehicle with the blade raised parallel to the vehicle.
Figure 10:
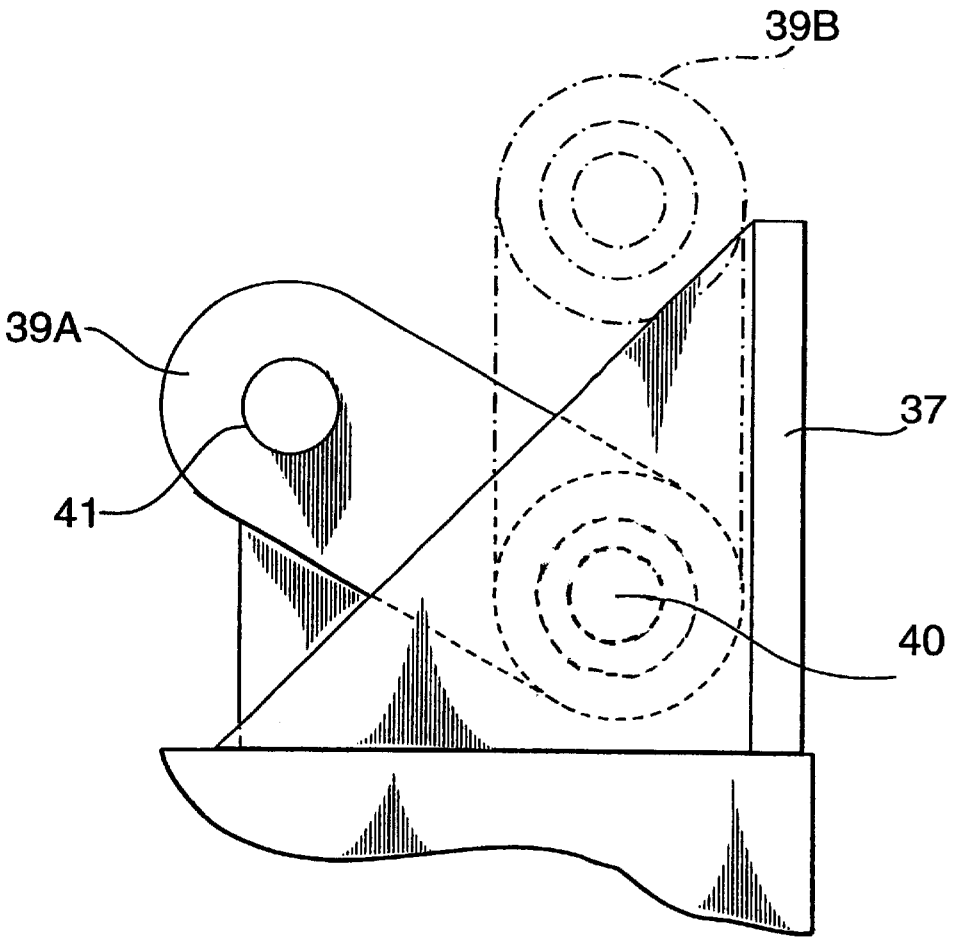
FIG. 10 is a fragmentary elevational view of a loose link assembly.
Figure 11:
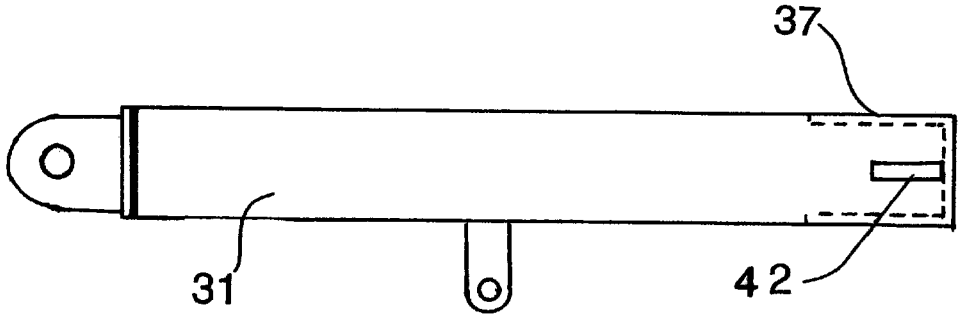
FIG. 11 is a plan view of the rear connector arm.

A further feature of the rear mounting assembly is a hydraulic lift cylinder 38 which connects between an upper region of the rear support 30 and a lug 37 extending upwardly from the top of arm 31. This cylinder 38 serves firstly to lift the arm 31 and thus the outer end of blade 12. A further feature of this hydraulic lift cylinder arrangement is a loose link connection 39 to the arm 31. This is in the form of a short linkage which is pivoted to lug 42 on arm 31 by way of pivot 40 and connected to the lift cylinder by way of pivot 41. This loose link or arm 39 is able to swing between positions 39*a* and 39*b* as shown in FIG. 10 as well as in FIGS. 7 and 8. The position as shown as 39*a* in FIG. 10 and as shown in FIG. 8 is the general operating position for the plow. However, when the blade 12 hits an obstacle, the link 39 swings to the position 39*b* as shown in FIG. 10 and as shown in FIG. 7. This permits the outer end of blade 11 to bounce over the obstruction while avoiding any damage.

The bracket 37 includes a vertical end plate which serves as a stop for the linkage 39. Thus, in the position 39B in FIG. 10 the lift cylinder 38 can be extended so that the loose link becomes a solid linkage at horizontal or higher levels of arm 31. This may be used, for instance, when the blade wants to jump over hard drifts.

It is within the ambit of the present invention to cover any obvious modifications of the example of the preferred embodiment described herein, provided such modifications fall within the scope of the broad claims appended hereto.

What is claimed is:

1. A side wing plow assembly for use on a vehicle having a support frame and cab, comprising:

an elongated blade having an inner end and an outer end;

an articulated forward connector assembly for connecting the inner end of said blade to the vehicle, said forward connection assembly including:

(a) a generally vertical inner plate member for attachment to the vehicle frame;

(b) a generally vertical outer plate member laterally spaced from said inner vertical plate;

(c) a transverse plate member pivotally connected to lower regions of said inner and outer plate members;

(d) an upper hydraulic cylinder connected between upper regions of said inner and outer plate members and a lower hydraulic cylinder connected between an upper region of said inner plate member and a lower region of said outer plate member, said upper cylinder being adapted to tilt the outer plate member and blade and said lower cylinder being adapted to raise and lower the outer plate member and blade;

(e) a blade support plate hinged to said outer plate member by means of a vertical hinge, with the blade being connected to said support plate by means of a horizontal pivot pin allowing the blade to swing up and down relative to the support plate, and a rear connector assembly for connecting the outer end of the blade to said vehicle rearwardly of the vehicle cab comprising:

(f) a telescopic arm having an inner end and an outer end pivotally connectable at its inner end to said vehicle and pivotally connected at its outer end to the outer end of the blade, said telescopic arm including a hydraulic cylinder for extending and retracting the telescopic arm, and (g) a further hydraulic cylinder pivotally connectable between said vehicle and an upwardly extending bracket on said telescopic arm, said further hydraulic cylinder being adapted to raise and lower the outer end of the blade.

2. A side wing plow assembly as claimed in claim 1 wherein said telescopic arm connected to the outer end of the blade is provided with means for resiliently resisting inward movement of the outer end of the blade.

3. A side wing plow assembly as claimed in claim 1 wherein the hydraulic cylinder for extending and retracting the telescopic arm is connected to said upwardly extending bracket by way of a loose link in the form of a short pivot arm between the bracket and one end of the telescopic arm hydraulic cylinder, said pivot arm being adapted to lie in generally axial alignment with the telescopic arm hydraulic cylinder under normal operation and to swing upwardly into a generally vertical position when the blade encounters an obstacle.

4. A side wing plow assembly as claimed in claim 3 wherein the upwardly extending bracket on said telescopic arm includes a stop member which limits the upwardly swinging movement of said loose link.

5. A side wing plow assembly as claimed in claim 1 wherein the inner and outer plate members of the forward connector assembly are U-shaped with a central web and short side arms.

6. A side wing plow assembly as claimed in claim 5 wherein the transverse plate member connected between the inner and outer plates is U-shaped with a central web and short side arms, said transverse plate member extending across between the side arms of the inner and outer plates and being connected thereto by way of pivot pins.

7. A side wing plow assembly as claimed in claim 1 wherein the forward connector assembly is adapted to be connected to the vehicle frame toward the front of the vehicle cab.

8. A side wing plow assembly as claimed in claim 7 wherein the blade is adapted to swing into a transport position in which the blade is raised and substantially parallel to the longitudinal axis of the vehicle.

9. A side wing plow assembly as claimed in claim 8 adapted to be mounted on the frame of a motor grader.

* * * * *